United States Patent [19]

Martin

[11] 4,225,277

[45] Sep. 30, 1980

[54] CHARGING DEVICE FOR FURNACES

[76] Inventor: Johannes J. Martin, Leopoldstrasse 248, 8000 München 40, Fed. Rep. of Germany

[21] Appl. No.: 930,568

[22] Filed: Aug. 3, 1978

Related U.S. Application Data

[63] Continuation-in-part of Ser. No. 717,550, Aug. 25, 1976, abandoned.

[30] Foreign Application Priority Data

Aug. 28, 1975 [DE] Fed. Rep. of Germany ..... 2538380

[51] Int. Cl.[2] ..... B65B 69/00; F23G 5/00

[52] U.S. Cl. ..... 414/198; 414/412

[58] Field of Search ..... 414/198, 208, 412; 83/597; 225/104

[56] References Cited

U.S. PATENT DOCUMENTS

| | | | |
|---|---|---|---|
| 2,131,499 | 9/1938 | Cruse | 414/412 |
| 3,170,577 | 2/1965 | Martin | 414/198 |
| 3,696,951 | 10/1972 | Toppins et al. | 414/525 |
| 3,891,105 | 6/1975 | Cerroni | 414/412 |

*Primary Examiner*—Robert G. Sheridan
*Attorney, Agent, or Firm*—Michael J. Striker

[57] ABSTRACT

A device for feeding bagged refuse into furnaces for incineration purposes has a chute defining a charging path, and ripping and/or slitting instrumentalities along this path for opening up the bags so as to permit the refuse to leave the same during travel of the bags along the charging path towards the combustion chamber.

18 Claims, 14 Drawing Figures

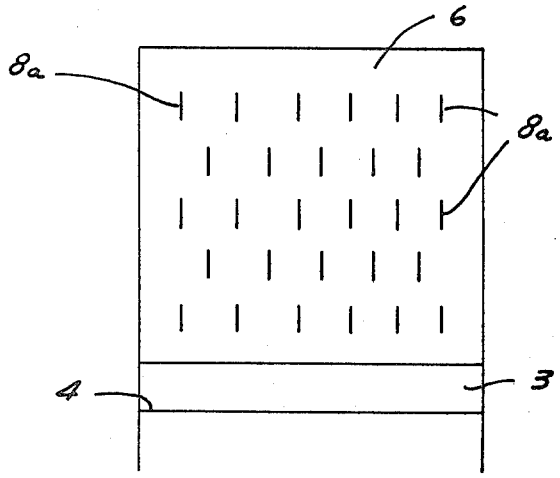
FIG. 9
FIG. 10
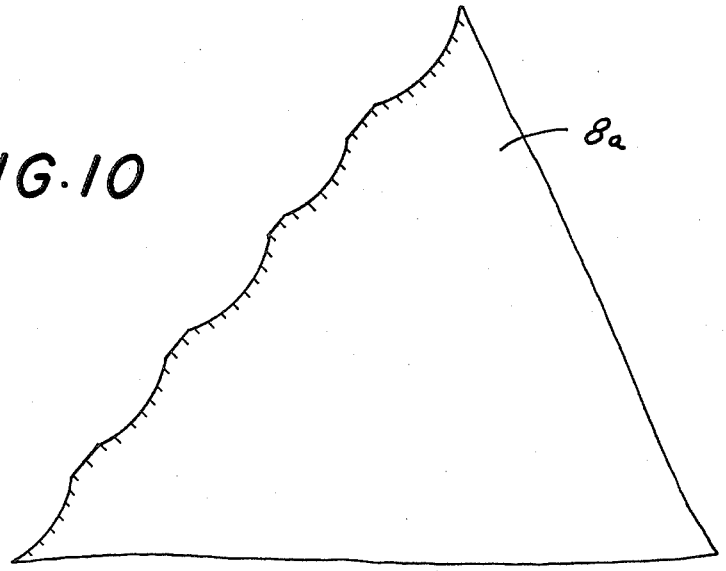

CHARGING DEVICE FOR FURNACES

CROSS REFERENCES TO RELATED APPLICATION

This is a continuation-in-part of my copending application Ser. No. 717,550, filed Aug. 25, 1976 now abandoned.

BACKGROUND OF THE INVENTION

This invention relates to a charging device for refuse-burning furnaces, particularly large furnaces, which conveys and supplies the refuse up to a location from which the refuse falls into the combustion chamber.

Urban refuse is collected to an increasing extent in bags of paper and synthetic plastic material. These are convenient and odour-free in use. However, in terms of furnace technology, i.e., when the refuse is to be incinerated, they have the disadvantage that they compact the refuse (see, for example U.S. Pat. No. 3,696,951), make the necessary intermixing difficult and, when charged into the furnace, screen the refuse from immediate contact with the generally preheated combustion air and the radiant heat from the combustion chamber. Plastic sacks fed simultaneously in large numbers into the furnace tend to slide against one another and prevent their being charged in a controlled manner. All of this results in unsatisfactory burning of the refuse.

Disadvantages of this type may be avoided by mechanically crushing the refuse before it is fed into the charging chute but this is often impossible in existing plants for structural reasons and in any case, may be very expensive.

It is also known in the art of charging devices to provide a charging apparatus for furnaces with a charging chute having two walls, one of which is provided with stationary ripping elements (see, for example U.S. Pat. No. 3,696,951) operative to tear up refuse bags inserted in the chute.

A common problem with such arrangements is that the relatively tall descending column of the refuse tends to pack in the chute, forming a plug of compressed refuse which becomes increasingly incapable of moving downwardly in the chute towards the furnace. Such a situation is especially likely to occur if among the refuse there happen to be a few bulky items. In this case these items may only partially block the chute but the incoming additional refuse will block the remainder of the chute cross-section and the resulting plug will become increasing compacted due to the pressure of still further refuse arriving through the inlet of such an arrangement.

The known charging devices do not provide any means for preventing development of such a plug or for preventing the compacting of the refuse.

It is to be understood in this context that providing only one wall of the chute with the stationary elements (see, for example, U.S. Pat. No. 3,696,951) will not prevent the development of such a plug.

It is also necessary to emphasize most strongly that even in prior-art instances where tearing-open of refuse bags is accomplished, it is nevertheless desired to further compact the liberated refuse. This is done in instances where dense packing of a space with refuse is desired. Of course, under such circumstances the compacted refuse—even though liberated from the bags—will burn only very poorly, if at all because, contrary to the invention, it will not be loosened up.

SUMMARY OF THE INVENTION

The general aim of the present invention is to provide a charging device for furnaces, especially for large furnaces, which avoids the disadvantages mentioned above.

More particularly, it is an object of the present invention to provide a charging device which eliminates the compacting of refuse in its feeding chute.

Another object is to provide such a charging device, which not only decisely counteracts the undesirable prior-art compacting tendency for the refuse by loosening the incoming refuse, but also promotes good intermixing of the refuse.

An additional object is to provide a device of this type which offers good contact of the refuse with the combustion air during the charging phase by loosening up the refuse and thus exposing a maximum refuse surface to the effect of the heat radiating from the combustion chamber.

Moreover, the device is to prevent uncontrolled sliding of the smooth (e.g., plastic) bags.

In pursuance of these objects and others which will become apparent hereafter, one feature of the present invention resides in providing a combustion chamber having an inlet and a charging edge inwardly spaced from the inlet. Below the inlet, there are provided path defining means which include a gravity chute having a first wall and a second wall spaced from each other so as to define a path therebetween along which refuse bags move under the influence of gravity towards the charging edge. The device is further provided with means for preventing compacting of refuse in the path and for loosening the refuse to increase its exposed surface area, including ripping elements mounted on each of said walls along the path for ripping the bags open solely as a function of the gravity movement of the bags over and in contact with the ripping elements, so that the refuse contained in the bags is liberated and loose refuse can drop out of the ripped bags freely and solely under the influence of gravity for descent in direction towards the charging edge leading into said chamber. At least some of said ripping elements have ripping edges inclined downwardly relative to the movement of the bags in said path to thereby facilitate movement of the refuse in said path towards the discharging edge and counteract any refuse compacting tendency.

The ripping elements may be disposed on fixed and/or movable surfaces of the charging device.

One embodiment of the invention provides for the ripping elements to be disposed on surfaces which are movable relative to one another, so that a more intensive action of the ripping elements upon the refuse bags occurs. During relative movement of the ripping elements, the refuse and the refuse bags are agitated as a result of the cooperation of the stationary and movable ripping elements.

In the case of a charging device having charging pistons below the charging chute, which convey the refuse (optionally over a feeding table) to the charging edge, ripping elements may be disposed on the charging pistons, preferably on the upper side in the region of the front ends of the charging pistons. The desired effect is heightended if the ripping elements are disposed not only on the charging pistons but also on the feeding table itself, so that substantial relative displacements occur between adjacent ripping elements which facilitates the ripping open of the bags. Since the effectiveness of the tearing and/or cutting process increases with increasing relative displacement of adjacent ripping elements, it is advantageous if, instead of one or two charging pistons, several pistons or push rods are used which operate in opposite directions or in varying rhythms and which are fitted with the ripping elements. Even though the tearing action resulting from disposal of ripping elements on the charging pistons, which are movable relative to one another, is particularly high, the effect of the ripping elements which are disposed in the charging chute may be increased still more in that one or more wall regions or an entire wall, preferably the rear wall of the charging chute, is disposed movably in a longitudinal direction of the charging chute so that an intensive relative displacement occurs between the downward sliding refuse bags and the ripping elements.

The ripping elements may be disposed rigidly or freely pivotably on their associated surfaces. In both cases it is advantageous if the devices are replaceable, in order on the one hand to replace damaged parts and on the other hand to be able to adapt the ripping elements to modified conditions. Freely pivotable ripping elements may be used only on necessarily movable surfaces which are moved both in and opposite to the feed direction of the refuse since swivelling of the freely ripping elements occurs only in this manner.

In order to act upon any of the refuse bags which may emerge substantially undamaged from the charging chute and become located on the surface of the refuse conveyed by charging pistons to the charging edge, a further embodiment of the invention provides for the ripping elements to be disposed on the end of the charging chute above the charging pistons on a roller cylinder which executes controlled movements. The roller may be rotatable in the same or in the opposite direction as the movement of the refuse, or in a combination of these movements (e.g., in the "Pilgrim Step" manner).

The ripping elements may comprise triangular blades of which one side rests on the associated surface whereas one or both of the remaining sides are provided with a cutting edge which is preferably provided with serrations by cylindrical grinding on one or two sides. In the case of pivotable constructions, it is advantageous if the swivel axis is located at a corner of a triangular blade and if only the side lying opposite this corner is provided with a cutting edge. Furthermore, the ripping elements may comprise sharp-edged or hooked projections. The ripping elements may be disposed regularly or irregularly along the path of the refuse in the charging device. Preferably the ripping elements are disposed in a checker-board pattern. To increase their resistance to wear, their tearing and cutting edges may be provided with hard metal coatings which are preferably applied by electro-welding. The advantage of such welding is that the weld surface is rough and assists the tearing process.

A particularly important aspect of the invention is that the ripping elements in the path-defining chute having flanks which are clearly declined, i.e., which taper downwards in the directly of refuse movement. This avoids interfering with the refuse movement, especially with the movement of occasional bulky items. It is clear that if the flanks were inclined upwardly, i.e., if their tips were to face opposite to the refuse movement, bulkier items would become hung up on the ripping elements and newly incoming refuse would cooperate with these bulkier items and plug the chute.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 9 is a schematic view of arrangement blades on a corresponding wall of the charging chute; and FIG. 10 shows a blade employed in the present invention.

DESCRIPTION OF THE PREFERRED EMBODIMENTS

Before beginning with a description of the embodiments it is important to note that, although the ripping elements may be mounted on movable surfaces, the basic aspect of the invention provides for them to be on stationary surfaces so that the ripping-open of refuse bags is effected only by the kinetic energy of the bags which results from their movement along the path under the influence of gravity acting upon their weight. This eliminates the need for separate mechanical devices and greatly reduces the cost of such equipment.

Figure 1:
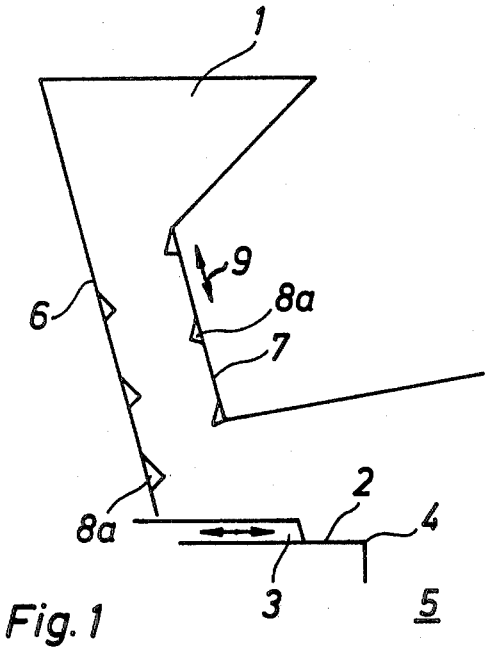
FIG. 1 is a section through a charging chute having ripping elements according to the invention.

With that in mind it will be seen that FIG. 1 shows a charging chute 1 from which the charged refuse passes to a feed table 2 on which a reciprocable charging piston 3 is disposed which conveys the refuse from the charging chute 1 over table 2 and to the charging edge 4, from whence the refuse passes into the combustion chamber 5. In order to tear and/or cut open the refuse bags thrown into the charging chute 1, one or both of the walls of the charging chute, in the example shown both the front wall 6 and the rear wall 7, are provided with triangular blades 8*a*, preferably arranged in a checker-board pattern and the refuse bags slide past these blades and are ripped open. The rear wall 7 of the charging chute 1 may be constructed so as to be reciprocable in the direction of the arrow 9, in order to increase the action of the blades 8*a* upon the refuse bags which slide past it, but this need not be the case as totally satisfactory results can be obtained without it.

The cutting edges of at least some and preferably all of the blades 8*a* are inclined downwardly relative to the movement of the bags through the chute 1, so as to facilitate movement of the refuse in the chute 1 towards the charging edge 4. It is important that in this, as in all other embodiments disclosed herein, the ripping elements or blades open up the bags, loosening the refuse and allowing to run in a stream along the path. This eliminates the disadvantageous compacting found in the prior art and assures that the surface area (of the loosened refuse) which is exposed to heat is substantially increased so that a more complete buring of the refuse will take place.

Figure 1A:
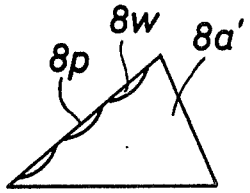
FIGS. 1*a* and 1*b* are diagrams to an enlarged scale, illustrating respective cutting devices.
Figure 1B:
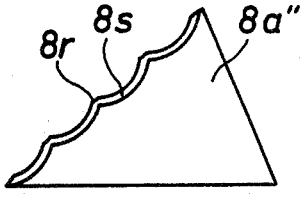

FIGS. 1*a* and 1*b* show cutting devices in the form of triangular blades 8*a* and 8*a'*. The blade 8*a* has a cylindrical grinding which is effected in such a manner that despite the individual wavelike recesses 8*w* a continuous cutting edge 8*p* remains. In the blade 8*a'* the individual wavelike recesses 8*s* are so deep that saw or tearing teeth 8*r* are produced. Grinding in FIG. 1*b* may be carried out on one or on both sides of the blade. The wavelike recesses 8*w* and 8*s* may have a hard metal coating applied by metal-deposition welding.

Figure 2:
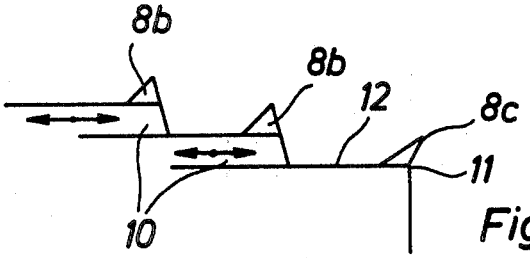
FIG. 2 shows an arrangement of ripping elements on charging pistons of a charging device.

In FIG. 2, triangular blades 8*a* and 8*c* are disposed on the upper side of the front ends of reciprocable charging pistons 10 and in the region of the charging edge 11 of a feed table 12 on which the lower of the two charging pistons 10 is displaceably guided, while the upper charging piston rests on the lower charging piston and may be displaceable relative to it. In this embodiment, the tearing and/or cutting effect is particularly great if the blades 8*b* on the charging pistons are movable relative to one another and are also displaceable relative to the fixed blades 8*c* on the charging edge 11 since, by these means, a braking action is exerted upon the refuse, causing turningover of the refuse so that, at each stroke, new surfaces of the refuse bags are moved against the counteracting ripping elements.

Figure 3:
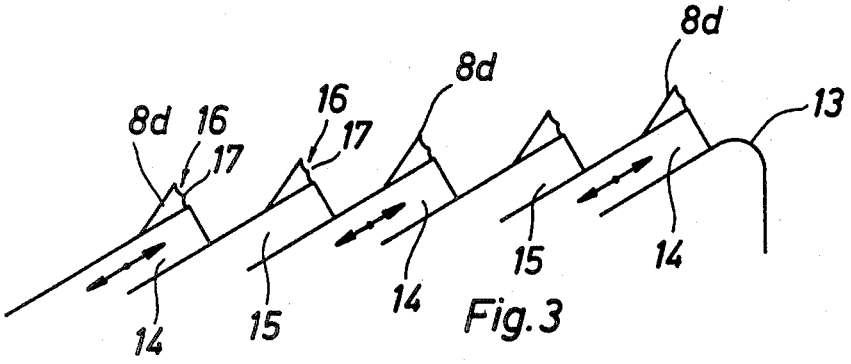
FIG. 3 shows the arrangement of ripping elements on several charging pistons of a charging device.

FIG. 3 shows a variant of a charging device which comprises several charging pistons 14 which feed obliquely upwards towards a charging edge 13 and between each of which a fixed piston 15 is disposed. The movable piston 14 as well as fixed pistons 15 are provided on their surfaces in the region of their front ends with triangular blades 8*d* which are subject in operation to relative displacements. Each of the triangular blades 8*d*, which are aligned in the feed direction of the refuse and are fixed on the upper surfaces of the pistons, has a side 16 provided with serrations 17 which are formed by cylindrical grinding on this side.

Figure 4A:
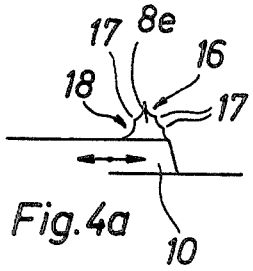
FIGS. 4*a* to 4*c* show various arrangements of ripping elements on charging pistons of a charging device.
Figure 4B:
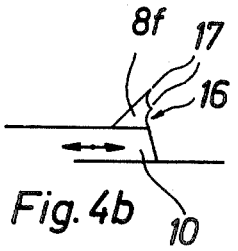
Figure 4C:
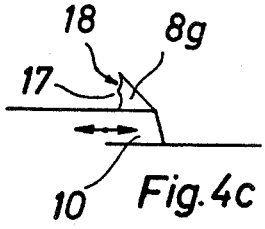

FIG. 4 shows various ways of construction and disposing tearing and cutting blades 8*e*, 8*f*, 8*g*, all the blades preferably being disposed at the front end of a charging piston 10 on its upper surface. The embodiments differ in that the blade 8*e* has a cylindrical grinding on both sides 16 and 18 and is provided with serrations 17 formed as a result of this grinding, while the blades 8*f* and 8*g* only have a cylindrical grinding with serrations on one side 16. The blades 8*f* and 8*g* differ in that in the blade 8*f* the side 16 is provided with a cutting edge, while the blade 8*g* has a cylindrical grinding on the side 18. Thus, different modes of operation are achieved. Whereas the blade 8*e* is effective in any direction of movement of the charging piston 10, in the case of blade 8*f* tearing-open of the refuse bags and loosening of the refuse occur only during the forward or feed stroke whereas the blade 8*f* operates less effectively during the return stroke of the charging piston 10. Compared to the blade 87, the blade 8*g* has a tearing and cutting action during the return stroke of the charging piston 10 while during the forward or feed stroke it has more of a regrouping cutting effect.

Figure 5:
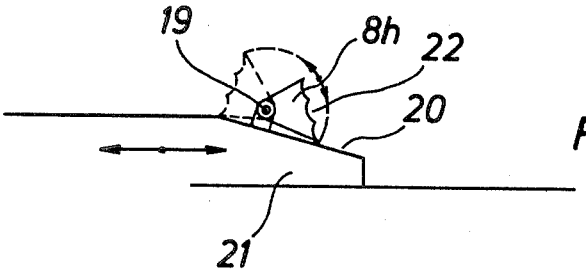
FIG. 5 shows another embodiment according to the invention having a pivotable ripping element on a charging piston.

FIG. 5 shows a triangular blade 8*h* which is pivotably journalled by means of a pivot 19 on an inclined surface 20 of a charging piston 21. The pivot 19 is provided at a corner of the triangular blade 8*h* which latter is only provided with one cutting edge located on the side 22 opposite the pivot 19. In FIG. 5, the solid lines show one and the dotted lines show the other end position of the freely pivotable blade 8*h*. Pivoting of the blade occurs as a result of the displacement of the charging piston 21 relative to the refuse located above it, at which the blade 8*h* finds the resistance required for pivoting. In so doing, the corners and the ground side 22 become effective for ripping the bags.

Figure 6:
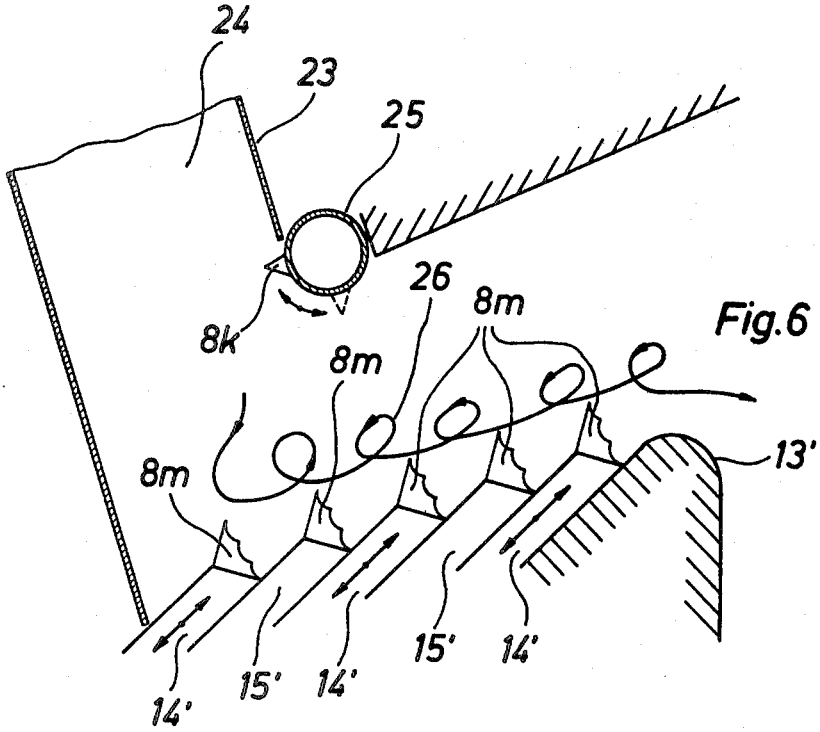
FIG. 6 is a section through another embodiment of a charging device according to the invention.

FIG. 6 shows a charging device in which, above several charging piston similar to the arrangement of FIG. 3, a roller 25 is rotatably journalled at the lower end of the rear wall 23 of a charging chute 24. Said roller is provided with blades 8*k* which, as the roller 25 rotates to and fro between the end positions illustrated by solid and dotted lines, act upon the refuse which is fed past underneath the roller 25. The roller 25 may be controlled in such a manner that it rotates in the same direction or in the opposite direction relative to the movement of the charging pistons 14'. Of course, a combination of these movement possibilities is preferably also selectable. A drive for the roller is conventional. The movable charging pistons 14' and the fixed pistons 15' disposed between them are provided at their front ends with blades 8*m* similar to those shown in FIG. 4. The charging pistons 14' convey the refuse towards the charging edge 13', the refuse undergoing a turning movement according to the arrow 26.

Figure 7:
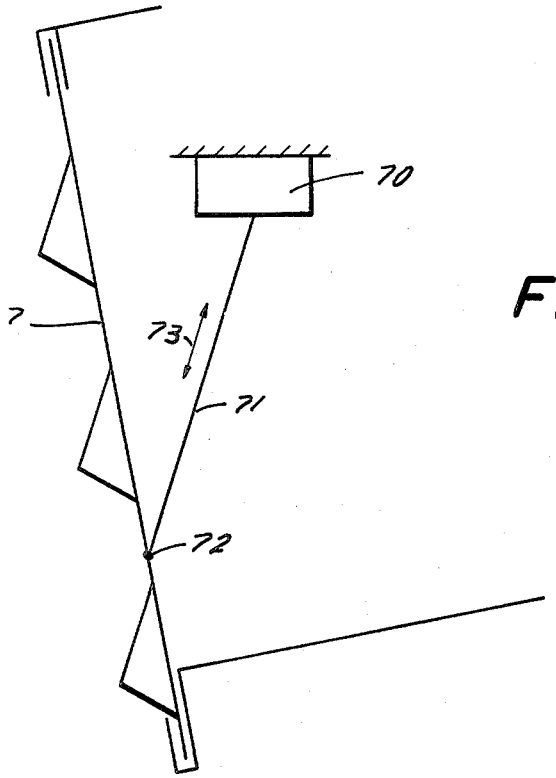
FIG. 7 is a schematic view of means for reciprocating in the charging device.

FIG. 7 shows how the wall 7 (and/or the wall 6) of the embodiment of FIG. 1 or of an analogous embodiment may be moved. For this purpose, a device 70 (e.g., a cylinder-and-piston unit, a solenoid or the like) may be mounted on a stationary element, and be linked to the wall 7 via a linkage 71 which is pivotably connected to the wall at 72. Operation of the device 70 then reciprocates the linkage 71 in the direction of the arrow 73 and thereby raises and lowers the wall 7.

Figure 8:
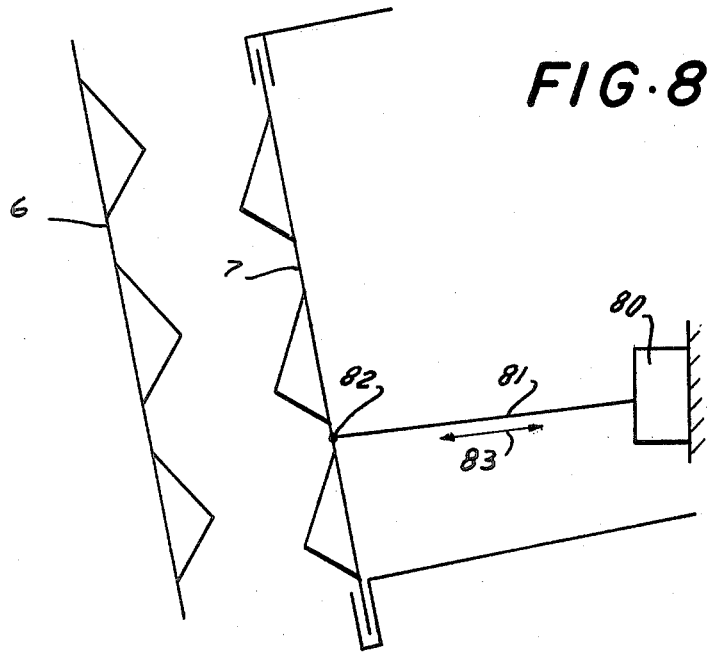
FIG. 8 is a schematic view of means for varying the cross-section of the path.

FIG. 8 shows how the cross-section of the refuse path may be varied. This is again shown with respect to wall 7, except that here the device 80 (which may be identical to the device 70) is mounted so that, when it operates, the direction 83 in which it reciprocates the linkage 81 is substantially normal to the wall 7 (instead of inclined to it as in FIG. 7). Thus the wall 7, to which the linkage 81 is pivoted at 82, can be moved closer to or farther away from the wall 6 to vary the cross-section of the path defined between them. The wall 7 may be mounted on guides to slide towards and away from wall 6; the implementation of this is well known.

FIG. 9 shows a side elevation of wall 6 (but it applies to any wall having teeth or ripping elements 8*a*). It will be seen that the ripping elements 8*a* are arranged in checkerboard fashion, since this is advantageous in terms of obtaining maximum ripping action over the wall surface.

Finally, FIG. 10 shows a detail of one of the ripping elements 8*a* which has a base (where it secured to a wall), one straight cutting edge and one serrated cutting edge which is analogous to the popular serrated knife blades and which assures an excellent ripping action on the refuse bags.

The term "ripping" as used in the appended claims identifies a tearing and/or cutting action upon the bags by tearing and/or cutting devices, that is blades 8.

It will be understood that each of the elements described above, or two or more together, may also find a useful application in other types of a charging device differing from the types described above.

While the invention has been illustrated and described as embodied in a charging device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a furnace, a combination comprising a combustion chamber having an inlet and a charging edge inwardly spaced from said inlet; path defining means, including a gravity chute below said inlet and having a first wall and a second wall spaced from each other so as to define a path therebetween along which refuse bags move under the influence of gravity towards said charging edge; and means for preventing compacting and retention of the refuse in said path, including ripping elements mounted on each of said walls along said path for ripping said bags open solely as a function of the gravity movement of said bags over and in contact with said ripping elements, so that the refuse contained in said bags is liberated and loose refuse can drop out of the ripped bags freely and solely under the influence of gravity in direction towards said charging edge leading into said chamber, at least some of said ripping elements having ripping edges inclined downwardly relative to the movement of the bags in said path to thereby facilitate movement of the refuse in said path towards said charging edge and counteract any refuse retarding and compacting tendency.

2. A combination as defined in claim 1, further comprising means for reciprocating said ripping elements of at least one wall relative to the other in direction towards and away from said inlet.

3. A combination as defined in claim 2, further comprising means for varying the cross-section of said path to thereby increase contact of said bags with said ripping elements, thus increasing the efficiency of the ripping action.

4. A combination as defined in claim 3, wherein said ripping elements are blades mounted on said walls.

5. A combination as defined in claim 1, wherein said ripping elements are elongated strip-shaped members mounted on said walls extending lengthwise of said path, each of said members being formed with a plurality of longitudinally arranged ripping blades.

6. A combination as defined in claim 5, wherein said ripping blades are triangular.

7. A combination as defined in claim 6, wherein each of said triangular blades has one side on the associated surfaces of one of said walls and another side facing the opposite wall and having at least one ripping edge which diverges towards the opposite wall in direction of travel of the refuse through said chutes.

8. A combination as defined in claim 1, comprising charging pistons below the charging chute which convey the refuse to the charging edge, some of said ripping elements being mounted above said pistons in the region of the front ends thereof.

9. A combination as defined in claim 7, wherein said ripping elements are rigidly mounted on the surfaces of the wall associated with them.

10. A combination as defined in claim 7, wherein said ripping elements are mounted freely pivotably on their associated surfaces.

11. A combination as defined in claim 1, further comprising a roller which carries out controlled rotational movements; and charging pistons below said roller, said ripping elements on said roller being disposed at the end of said charging chute above said charging pistons.

12. A combination as defined in claim 11, wherein said roller is rotatable in the same or opposite directions or in a combination of these directions relative to the movement of the charging pistons.

13. A combination as defined in claim 7, wherein said blades are pivotable about an axis passing through a corner of a respective triangular blade.

14. A combination as defined in claim 1, wherein said ripping elements are disposed in a checkerboard pattern.

15. A combination as defined in claim 7, wherein said blades are provided on their ripping edges with a hard metal coating.

16. A combination as defined in claim 7, wherein said ripping edge is a cylindrically ground edge having upright orientation and serrations on one side.

17. A combination as defined in claim 7, wherein said ripping edge is a cylindrically ground upright edge provided with serrations at both sides.

18. A combination as defined in claim 14, wherein said blade is upright and provided with a cutting edge only in a region opposite said corner.

* * * * *